US006000810A

United States Patent [19]

Nolan et al.

[11] Patent Number: 6,000,810

[45] Date of Patent: Dec. 14, 1999

[54] LOW VOLTAGE STORAGE WAREHOUSE LIGHTING SYSTEM

[75] Inventors: Joseph P. Nolan, Kennett Square; Brian P. Nolan, Lincoln University; Ralph M. Kirchhofer, III, Kennett Square, all of Pa.

[73] Assignee: Eagle Energy Systems, Ltd., Kennett Square, Pa.

[21] Appl. No.: 09/037,335

[22] Filed: Mar. 10, 1998

[51] Int. Cl.[6] ..... F21S 1/02

[52] U.S. Cl. ..... 362/145; 362/225; 362/147; 362/251; 362/260

[58] Field of Search ..... 362/145, 147, 362/125, 260, 249, 251, 225; 315/291, 297, 312, 254; 52/28; 307/157

[56] References Cited

U.S. PATENT DOCUMENTS

| | | | |
|---|---|---|---|
| 4,001,571 | 1/1977 | Martin | 362/147 |
| 4,225,808 | 9/1980 | Saraceni | 362/125 |
| 5,132,884 | 7/1992 | Totten | 362/147 |
| 5,451,843 | 9/1995 | Kahn et al. | 315/291 |

*Primary Examiner*—Thomas M. Sember
*Attorney, Agent, or Firm*—Woodcock Washburn Kurtz Mackiewicz & Norris LLP

[57] ABSTRACT

According to the present invention a low voltage storage warehouse lighting system has a plurality of switch sets, a plurality of light sources, and a timer-relay station. Each switch set comprises a plurality of light switches electrically connected in serial with one another via low voltage wiring. The switch sets are located proximate associated file aisles. The low voltage wiring is disposed within the racks. A light source is located above each file aisle. Each light source is associated with one switch set and each said switch set associated with one light source. The timer-relay station is electrically connected via high voltage wiring to a breaker panel, via high voltage wiring to each light source, and via low voltage wiring to each switch set. The timer-relay station is adapted to transform high voltage input to low voltage and to illuminate each light source in response to electrical signals received from the switch set associated with the light source. Also, each file aisle has a corresponding preset time delay. The timer-relay station is adapted further to turn off the light source after the corresponding preset time delay.

8 Claims, 5 Drawing Sheets

LOW VOLTAGE STORAGE WAREHOUSE LIGHTING SYSTEM

FIELD OF THE INVENTION

The present invention relates to warehouse lighting systems. More particularly, the present invention relates to a low voltage, time-delay, lighting system for storage warehouses.

BACKGROUND OF THE INVENTION

The function of a storage warehouse is to store containers for long periods of time. Typically, a property owner packs property into a container and ships the container to the storage warehouse where the container is cataloged and stored in the warehouse until such time as the owner wishes to retrieve it.

To facilitate the storage of large numbers of containers, the storage warehouses employ rows of box shelving, or racks. A plurality of racks are aligned substantially parallel to one another and spaced so as to form file aisles between adjacent racks. A typical file aisle is approximately three feet wide. Each file aisle has an ingress and an egress. Thus, a worker can walk down a file aisle to shelve or unshelve a container. In an installation in which file aisles are very long, periodic breaks within a row of racks are employed. These periodic breaks form cross aisles. Thus, the layout of a typical storage warehouse comprises a matrix of racks.

Typically, each rack is several floors high and is divided into a plurality of levels. Typically, each level is 8–10 feet high, and each rack comprises 34 levels (although racks comprising up to eight levels are not uncommon). To enable a worker to access containers on an upper level, walkways are disposed in the file aisles between adjacent racks at every level. These walkways are essentially grates. Each file aisle has an ingress and an egress on each level.

Typically, large, existing warehouses are used for conversion into storage warehouses. Commonly, such existing warehouses are old and have high voltage electrical power input (e.g., 277 V). Some storage warehouses also have low voltage electrical power input (e.g., 120 V). Due to their large size, storage warehouses commonly use high intensity discharge (HID) lamps for lighting. Several problems are known to exist with this type of lighting system. HID lamps tend to become very hot in use and, consequently, present health and safety hazards. Also, HID lamps are basically point sources. Consequently, HID lamps radiate in a pattern such that the light is blocked by the grating of the walkways. One of the biggest drawbacks to using a lighting system based on HID lamps is that HID lamps are expensive to operate. Since HID lamps take a fairly long time to heat up and cool down, it has been observed that, in a storage warehouses employing a lighting system based on HID lamps, all the HID lamps in the storage warehouse are turned on at the beginning of the day, and burn constantly until the end of the day. Thus, HID lamps burn 100% of the day, in 100% of the storage warehouse. Since workers access only a relatively small portion of a storage warehouse at any given time, clearly a lighting system based on HID lamps is wasteful and expensive.

Several attempts have been made to develop lighting systems that use fluorescent light fixtures. These systems are improvements over the HID-based systems in that fluorescent light fixtures are cooler and, consequently, less hazardous. Fluorescent light fixtures are more efficient and, consequently, less expensive to operate. Additionally, fluorescent light fixtures are linear and, consequently, radiate more uniformly downward. Thus, less light is blocked by the grating of the walkways. However, it has been observed that lighting systems based on fluorescent light fixtures may still operate 100% of the day, in 100% of the storage warehouse.

To satisfy a need in the art for a storage warehouse lighting system that illuminates only the aisles within the warehouse that a worker is using, several attempts have been made to connect the fluorescent light fixtures to a timer system. It is known to install twist timers at each ingress and each egress of each level of each rack. However, it has been observed that warehouse lighting systems based on twist timers have several drawbacks as well. First, twist timers are expensive to install due to the sheer number of twist timers needed for a typical storage warehouse. Second, such a system is hazardous because twist timers require live high voltage in the racks. Third, high voltage lines must be run from the breaker panel, through conduits installed in the racks, to the timers, and back to the panel, thus adding considerable cost. Fourth, the ordinary use of twist timers in such an environment results in a considerable rate of breakage to the timers. Fifth, since the twist timers are located in the aisles, they can be overridden by anyone in the aisle. Finally, twist timer systems are not suitable for storage warehouses having 277 V high voltage input since commonly available twist timers do not operate using so high a voltage.

Warehouse lighting systems using motion detectors have also been attempted. However, it has been observed that the racks are too unstable for such a system. For example, a load of containers being brought into or out of the warehouse via a cross aisle frequently will shake the racks as it passes by, thus causing the motion detectors to illuminate a considerable number of file aisles that are not in use.

Thus, there is a need in the art for a low cost, energy efficient, tamper-resistant, low voltage storage warehouse lighting system that minimizes illumination of file aisles not being used.

SUMMARY OF THE INVENTION

A typical storage warehouse has a plurality of racks aligned substantially parallel to one another and spaced to form file aisles between adjacent racks. Each file aisle has a plurality of levels, with each level having an ingress and an egress. The storage warehouse has a high voltage input to a breaker panel. The present invention satisfies these needs in the art by providing a storage warehouse lighting system that reduces the cost of illuminating the storage warehouse by providing timing control over light sources associated with file aisles within the warehouse.

A storage warehouse lighting system according to the present invention comprises a plurality of switch sets, a plurality of light sources, and a timer-relay station. Each switch set comprises a plurality of light switches electrically connected in serial with one another via low voltage wiring. The switch sets are located proximate their associated file aisles and, preferably, one switch is located proximate each ingress and each egress on each level. The low voltage wiring is disposed within the racks.

A light source is located above each file aisle. Each light source is associated with one switch set and each said switch set associated with one light source. Preferably, the light sources are linear, the length of each light source approximately equal the length of the file aisle above which the light source is located. For example, the light sources may be fluorescent tubes or strings of fluorescent tubes. The light sources may be hung from the warehouse ceiling via hanging chains, or coupled between adjacent racks via brackets.

The timer-relay station is electrically connected via high voltage wiring to the breaker panel, via high voltage wiring to each light source, and via low voltage wiring to each switch set. The timer-relay station is adapted to transform high voltage input to low voltage. Preferably, the timer relay station comprises a plurality of transformers for this purpose. The timer-relay station is also adapted to illuminate each light source in response to electrical signals received from the switch set associated with the light source. Also, each file aisle has a corresponding preset time delay. The timer-relay station is adapted further to turn off the light source after the corresponding preset time delay. Preferably, the timer relay station comprises a plurality of relays for this purpose.

BRIEF DESCRIPTION OF THE DRAWINGS

The present invention will be better understood, and its numerous objects and advantages will become apparent by reference to the following detailed description of the invention when taken in conjunction with the following drawings, in which.

DETAILED DESCRIPTION OF THE PREFERRED EMBODIMENTS

A system and method which meets the above-mentioned objects and provides other beneficial features in accordance with the presently preferred exemplary embodiment of the invention will be described below with reference to FIGS. 1–5. Those skilled in the art will readily appreciate that the description given herein with respect to those figures is for explanatory purposes only and is not intended in any way to limit the scope of the invention. Accordingly, all questions regarding the scope of the invention should be resolved by referring to the appended claims.

Figure 1:
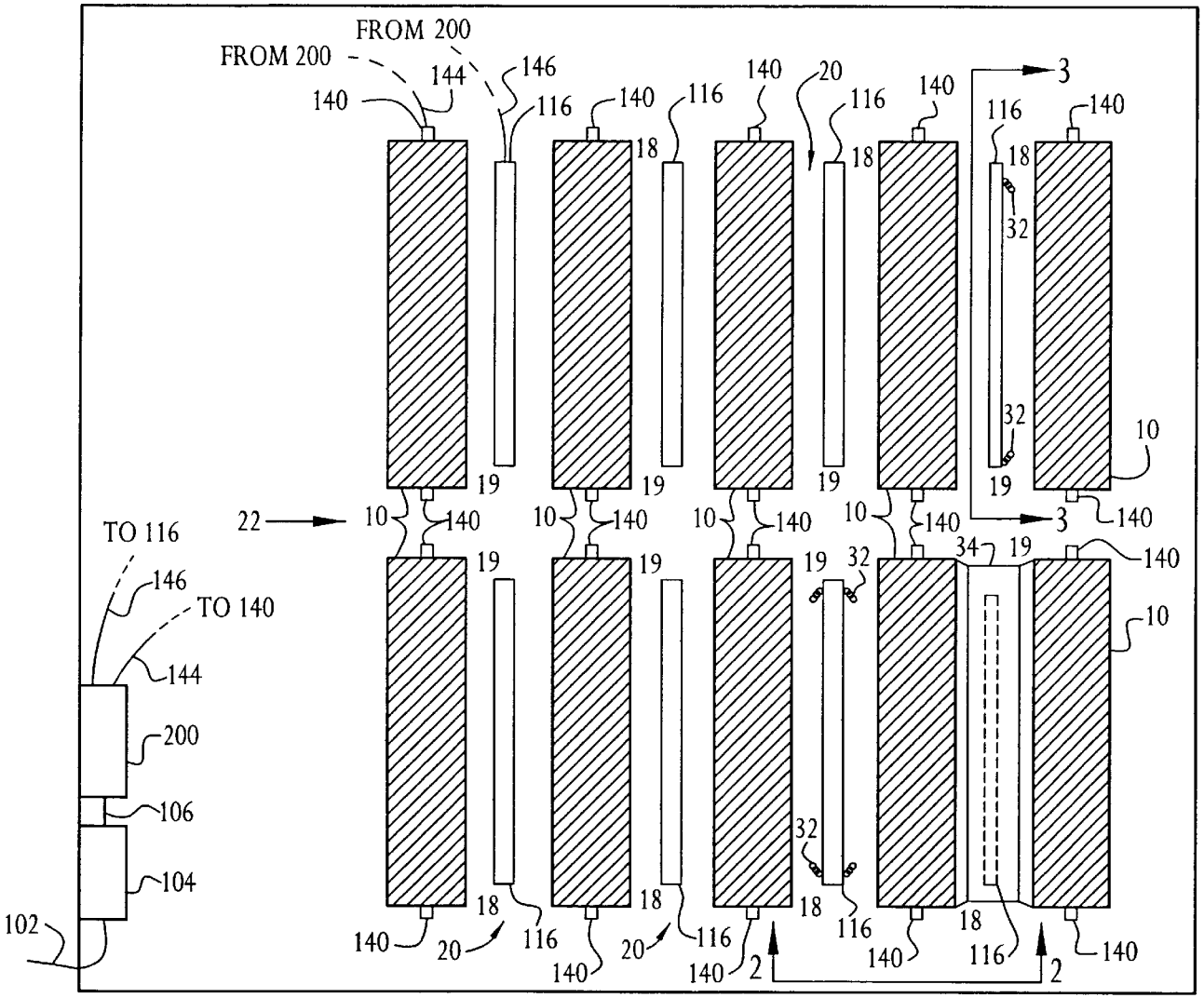
FIG. 1 shows an overhead view of a typical storage warehouse in which a lighting system according to the present invention has been installed.

FIG. 1 shows an overhead view of a typical storage warehouse 50 in which a lighting system according to the present invention has been installed. A plurality of box shelves, or racks, 10 are aligned substantially parallel to one another and spaced to form file aisles 20 between adjacent racks 10. A typical file aisle 20 is approximately three feet wide. Each file aisle has an ingress 18 and an egress 19. Thus, a worker can walk down a file aisle 20 to shelve or unshelve a container. In a warehouse installation in which file aisles 20 are very long, one or more cross aisles 22 may be employed. Thus, the layout of a typical storage warehouse 50 comprises a matrix of racks 10 as shown in FIG. 1.

Figure 2:
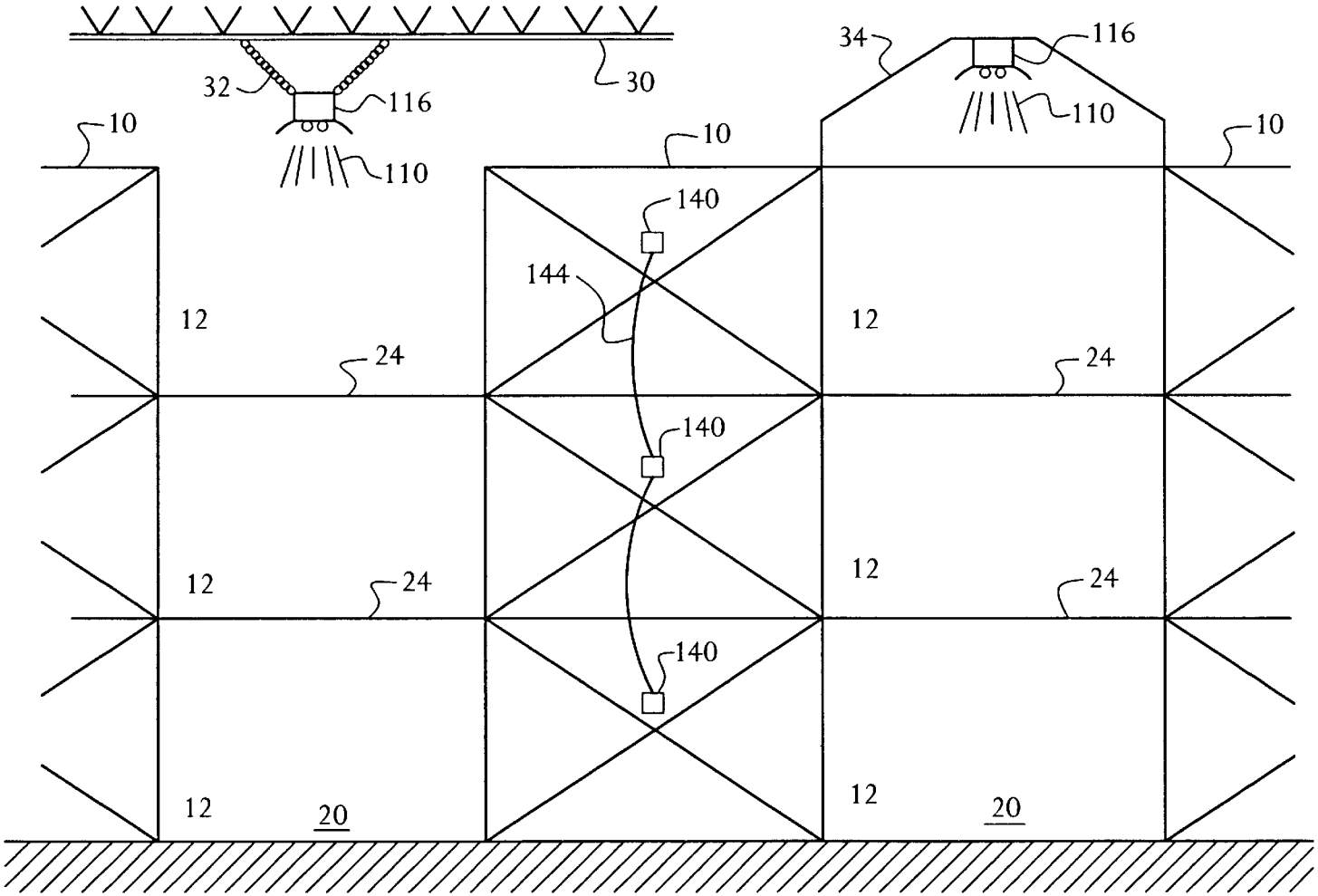
FIG. 2 shows a cross-sectional end view of a plurality of racks within the storage warehouse shown in FIG. 1 taken along line 2—2 thereof.

FIG. 2 shows a cross-sectional end view of a plurality of racks within storage warehouse 50 taken along line 2—2 of FIG. 1. Typically, each rack 10 is divided into a plurality of levels 12. Typically, each level 12 is 8–10 feet high, and each rack 10 comprises 3–4 levels 12 (although racks 10 comprising up to eight levels 12 are not uncommon). To enable a worker to access containers on an upper level 12, walkways 24 are disposed in file aisles 20, between adjacent racks 10, at every level 12.

At least one light source 116 is located over each file aisle 20. Light source 116 may be hung from warehouse ceiling 30 via a chain 32, or coupled to two racks 10 via a hanging bracket 34, depending on the specific application. Thus, light source 116 may be installed in the most cost effective manner possible for each application, depending on such variables as the distance between the top of rack 10 and warehouse ceiling 30, or the suitability of warehouse ceiling 30 for supporting light source 116, etc. Walkways 24 are configured as grates to allow light 110 from light source 116 to pass therethrough. Thus, when light source 116 is on, light 110 illuminates all levels 12 of file aisle 20. To provide the best illumination of lower levels 12 of aisle 20 in an application in which rack 10 has a considerable number of levels (e.g., more than four), additional light sources 116 may be hung between adjacent racks 10 using hanging brackets 34 at any level as needed.

Figure 3:
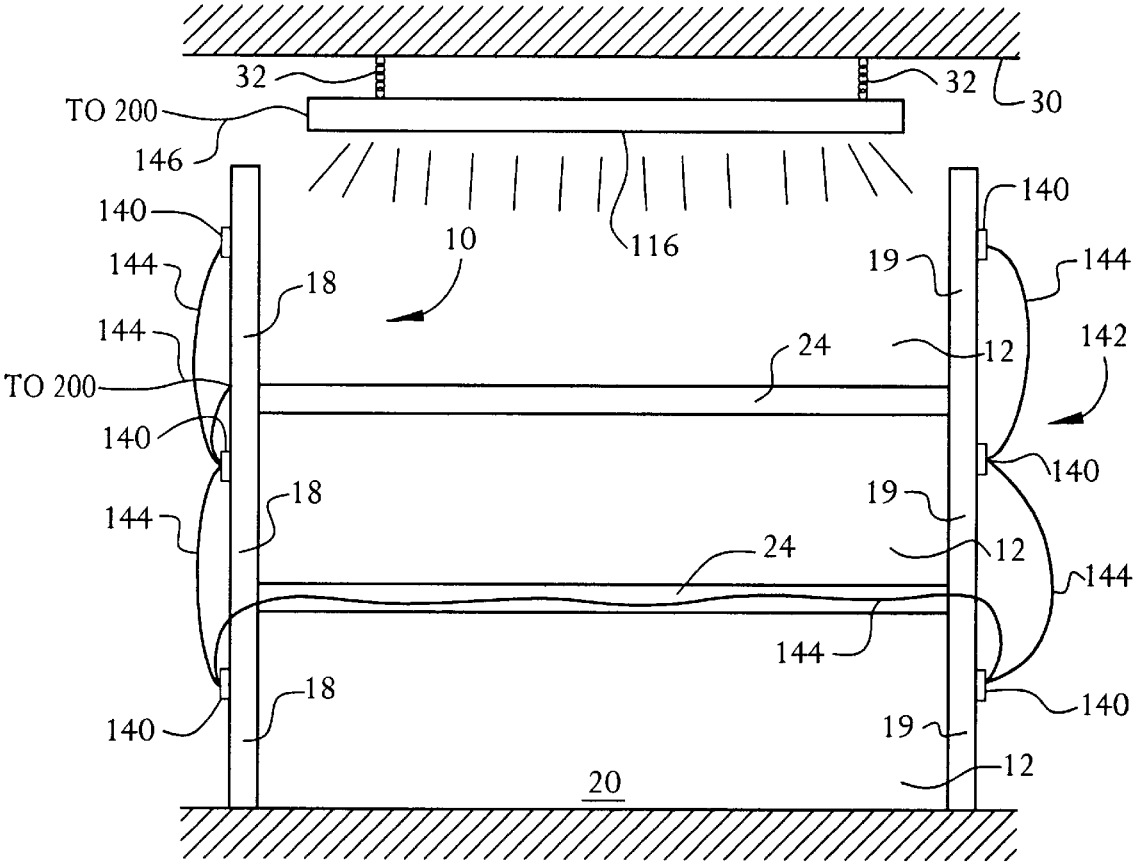
FIG. 3 shows a cross-sectional end view of a rack within the storage warehouse shown in FIG. 1 taken along line 3—3 thereof.

FIG. 3 shows a cross-sectional side view of a rack within storage warehouse 50 taken along line 3—3 of FIG. 1. As shown in FIG. 3, an ingress 18 and an egress 19 exists on every level 12. A switch 140 is disposed on rack 10, proximate each file aisle 20, at each ingress 18 and each egress 19 of every level 12. The plurality of switches 140 disposed on rack 10 are known collectively as a switch set 142. Switches 140 making up switch set 142 are electrically connected in serial with one another via a low voltage line 144. Switch set 142 is electrically connected via low voltage line 144 to timer-relay station 200.

As shown in FIG. 3, light source 116 is located over file aisle 20 above the uppermost level 12 of rack 10. Light source 116 is a linear light source having a length approximately equal (and preferably slightly less than) the length of file aisle 20. Preferably, light source 116 is a string of serially connected fluorescent tubes extending approximately the length of rack 10. Preferably, walkways 24 are in the configuration of grates to allow light 110 from light source 116 to shine down to lower levels 12 of file aisle 20. Light source 116 may be hung from warehouse ceiling 30 via a chain 32 (as shown in FIG. 3), or coupled to two racks 10 via a hanging bracket 34. Light source 116 is electrically connected via high voltage line 146 to timer-relay station 200 (not shown in FIG. 3).

Referring once again to FIG. 1, high voltage electrical energy is delivered to storage warehouse 50 via a high voltage input 102 to a breaker panel 104. Typically, high voltage input 102 delivers 277 V electrical energy into storage warehouse 50, although high voltage input 102 may deliver 347 V, 240 V, 120 V, or any other high voltage sufficient to drive the storage warehouse lighting system. Breaker panel 104 is electrically connected to a timer-relay station 200 via a high voltage line 106. Timer-relay station 200 is electrically connected to light sources 116 via high voltage lines 146 and to switches 140. Similarly, timer-relay station 200 is electrically connected to a plurality of switch sets 142 via low voltage lines 144. Preferably, low voltage lines 144 carry 24 V electrical energy, however, any suitable low voltage may be used. Timer-relay station 200 is adapted to transform high voltage to low voltage, to turn on light sources 116 in response to electrical signals received from switches 140, and to turn off light sources 116 after a preset time delay.

Preferably, timer-relay station 200 is located as near as possible to breaker panel 104. Locating timer-relay 200 near to breaker panel 104 reduces the time and materials costs associated with installing the lighting system 100. Additionally, by locating timer-relay 200 away from racks 10, the incidence of tampering is reduced (relative to the installation in which twist timers are installed in the aisles). Moreover, because timer-relay station 200 is a separate unit, timer-relay station 200 can be locked to reduce tampering further.

Although one timer-relay station 200 is shown in FIG. 1, more than one timer-relay station 200 may be used in an installation where racks 10 are located quite a distance from timer-relay station 200 (e.g., in an exceptionally large warehouse). In that case, a plurality of timer-relay stations 200 may be electrically connected in serial with one another via high voltage lines 106.

Figure 4:
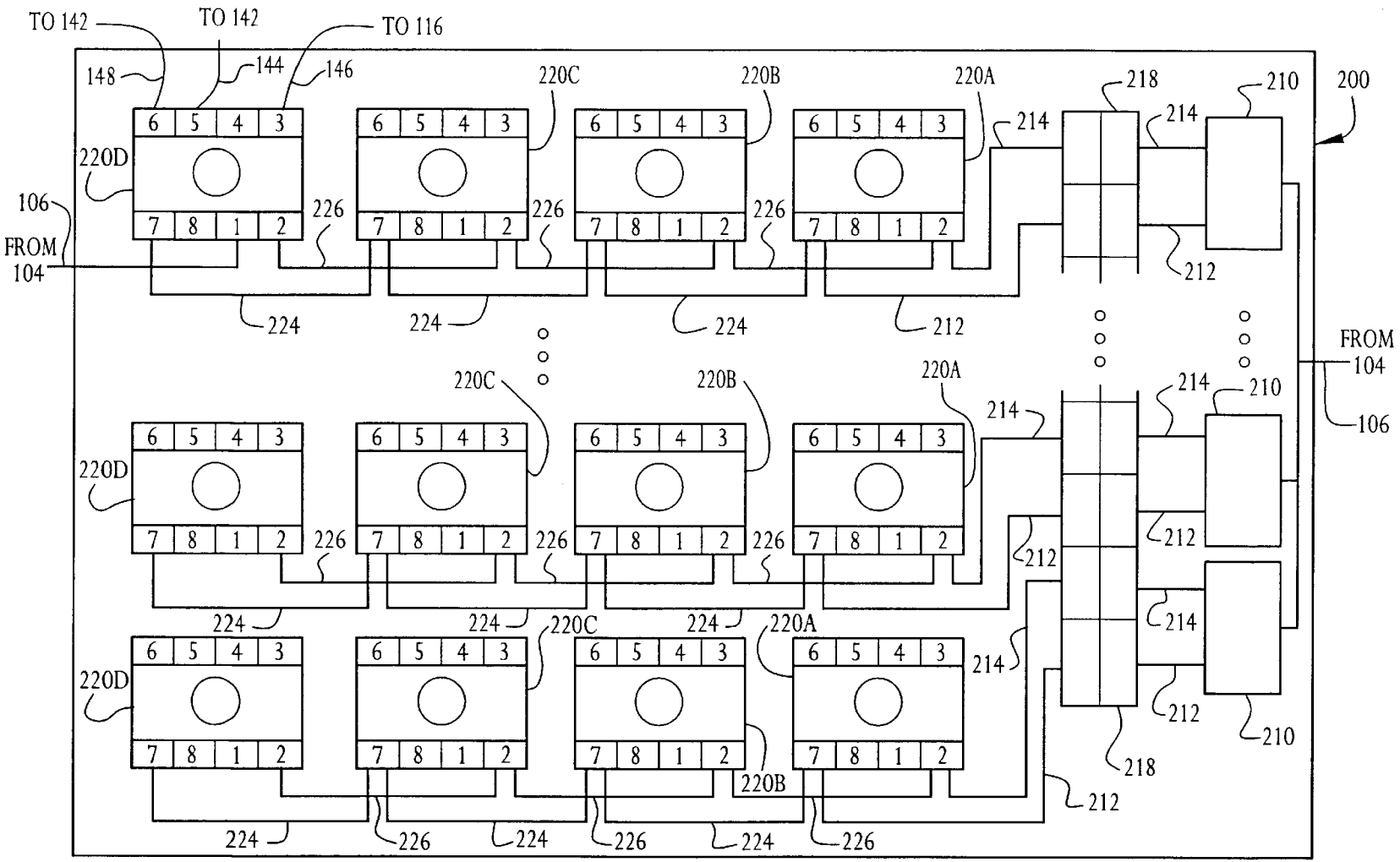
FIG. 4 shows a detailed view of a timer-relay station according to the present invention.

FIG. 4 shows a detailed view of a timer-relay station 200 according to the present invention. Timer-relay station 200 comprises a plurality of transformers 210 and a plurality of relay bases 220. High voltage input 106 from breaker panel 104 (not shown in FIG. 4) delivers high voltage electrical energy to transformers 210. Each transformer 210 transforms (or steps down) the high voltage (e.g., 347V, 277 V, 240 V, 120 V) to low voltage (e.g., 24 V). Transformer 210 is selected based on the high voltage input to the storage warehouse of the specific application. For example, in the United States, 277 V is typical and transformers therefor are selected accordingly, while in Canadian installations 347 V is common and transformers capable of accommodating that voltage are used.

Each transformer 210 is electrically connected, via a connector bar 218, to a plurality of relay bases 220. In a preferred embodiment, each transformer 210 is electrically connected to three or four relay bases 220. Each relay base 220 has a plurality of electrical connectors, preferably eight as shown in FIG. 4 and designated 1–8. High voltage electrical energy is delivered to connector 1 of each relay base 220, via high voltage input 106, from breaker panel 104 (not shown in FIG. 4). Each transformer 210 is electrically connected to connector 7 of a first relay base 220A via power wires 212. First relay base 220A is electrically connected in serial with relay bases 220B, 220C, and 220D via power jumper wires 224. Power wires 212 and power jumper wires 224 carry low voltage electrical energy (e.g., 24V). Similarly, each transformer 210 is electrically connected to connector 2 of first relay base 220A via neutral wires 214. First relay base 220A is electrically connected in serial with relay bases 220B, 220C, and 220D via neutral jumper wires 226.

In a preferred embodiment of the present invention, timer-relay station 200 includes one relay base 220 for each switch set 142 in storage warehouse 50. Each relay base 220 is associated with one switch set 142, and each switch set 142 is associated with one relay base 220. Each switch set 142 is electrically connected to connector 5 of its associated relay base 220 via low voltage wire 144 and to connector 6 of its associated relay base 220 via neutral wire 148. Similarly, each relay base 220 is associated with one light source 116, and each light source 116 is associated with one relay base 220. Thus, each switch set 142 is associated with one light source 116, and each light source 116 is associated with one switch set 142. Each light source is electrically connected to connector 3 of its associated relay base 220 via high voltage wire 146.

A relay 230 (not shown in FIG. 7) is snapped into each relay base 220. Relay 230 is powered by low voltage electrical energy delivered to relay base 220 via power wire 212, or power jumper wire 224. When any switch 140 within a selected switch set 142 is pressed, an electrical signal is delivered to relay 230 via low voltage wire 114. In response, relay 230 closes a connection between connector 1 and connector 3, thus delivering high voltage electrical energy, via high voltage line 146, to the light source 116 associated with the selected switch set 142. Thus, light source 116 is illuminated. Simultaneously, a timer within relay 230 is initiated. After a preset time delay, relay 230 opens the connection between connector 1 and connector 3, thus depriving light source 116 of high voltage electrical energy and, consequently, turning off light source 116.

Figure 5:
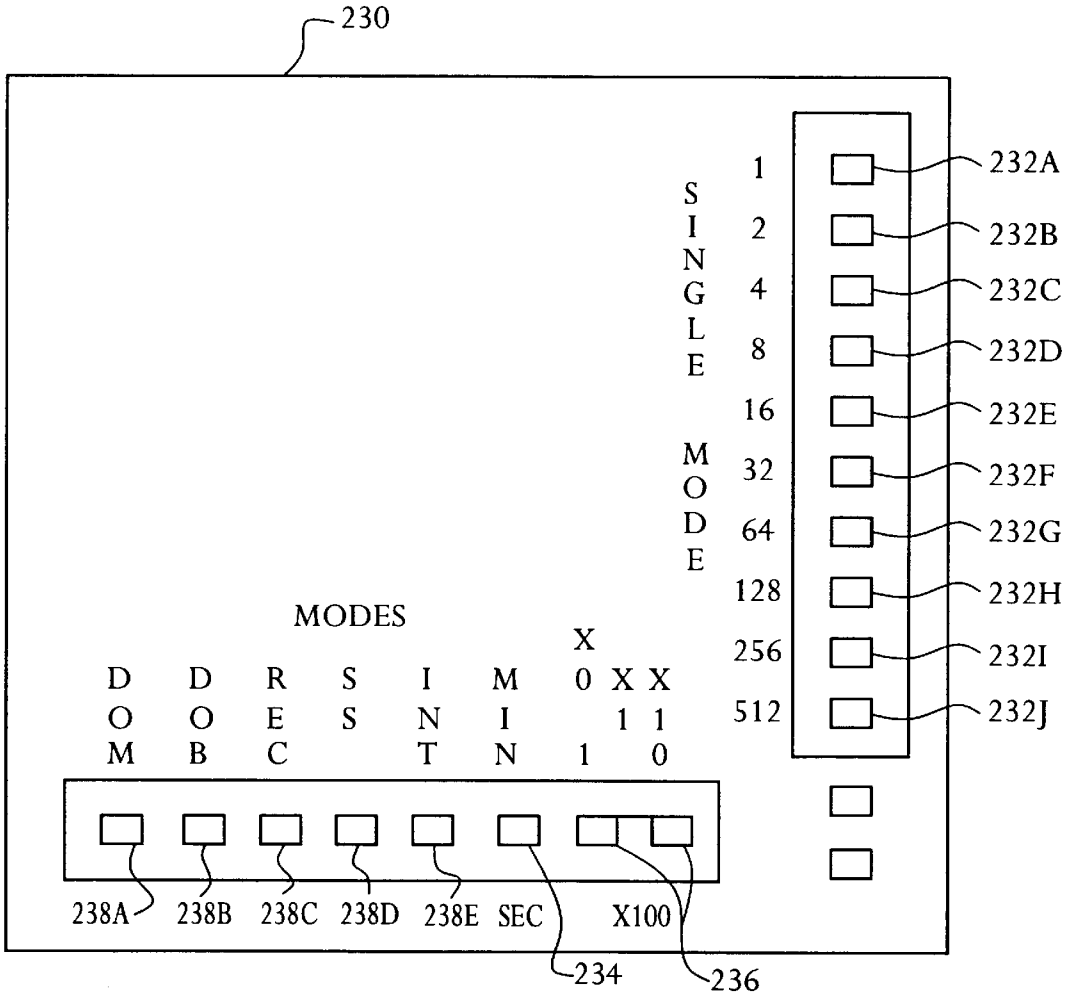
FIG. 5 shows a preferred embodiment of a relay used in accordance with the present invention.

Preferably, relay 230 is an SSAC TRDU24A2 or an Artisan Controls Corp. EPC-13464, however any suitable time delay mechanism may be used. An SSAC TRDU24A2, as shown in FIG. 5, has a plurality of numerical switches 232. Each numerical switch 232 represents a predetermined time period. By setting one or more numerical switches 232 to the "on" position, the user can vary the length of time for which light source 116 will remain illuminated when a switch 140 connected to relay 230 is pressed. In a preferred embodiment, relay 230 has ten numerical switches 232A–232J which range, in powers of 2, from 1 to 512 time periods. If all numerical switches 232 are closed, the time delay will be zero (i.e., light source 116 will not be illuminated even if a corresponding switch 140 is pressed). One or more numerical switches 232 may be opened simultaneously, with each open numerical switch 232 adding the corresponding number of time periods to the time delay. Thus, if all numerical switches 232 are open, the time delay will be 1023 time periods. The length of each time period is set via time units switch 234 and multiplier switches 236. Time units switch 234 can be set for seconds, SEC, or minutes, MIN. Multiplier switches 234 can be set to multiply the time units by 0.1, 1, 10, or 100. If both multiplier switches are closed, the multiplier is 100; if both switches are open, the multiplier is 1. A time period is the product of the multiplier and the time unit. Consequently, time periods may range from tenths of seconds to hundreds of minutes. Thus, the time delay may range from zero (all numerical switches 232 closed) to 102,300 minutes (all numerical switches 232 open, multiplier switches 236 set to ×100, and time units switch 234 set to MIN). It should be noted that, in a preferred embodiment, relay 230 can be overridden so that there is, effectively, an infinite time delay (i.e., light source 116 will remain illuminated until a corresponding switch 140 is triggered to turn it off. Similarly, an EPC-13464 will range from zero to 1024 minutes.

Relay 230 also has a plurality of mode switches 238A–238E. In a preferred embodiment, to activate relay 230, mode switches 238A and 238C are turned off, while the remaining mode switches, 238B, 238D, and 238E are turned on. This puts relay 230 into "Retriggerable Single Shot" mode. In this mode, if a switch 140 is pressed while light source 116 is already illuminated, the timer within relay 230 is reset. Thus, light source 116 will remain illuminated for one more time delay period (from the time switch 140 is last pressed).

To use the low voltage storage warehouse lighting system of the present invention, a worker desiring to enter a selected file aisle 20 simply presses a switch 140 at an ingress 18 or egress 19 associated with the selected file aisle 20. Since, preferably, a switch 140 is located at every ingress 18 and egress 19 on every level 12, wherever the worker desires to enter the selected file aisle 20, the worker can activate the lighting system. By pressing a switch 140, the associated relay 230 is activated, illuminating the light source 116 over the selected file aisle 20. The light source 116 remains illuminated until the preset time delay has expired, at which time the light source 116 turns off automatically. If, at any time while in a file aisle 20, a worker decides that the time delay is insufficiently long, the worker can press switch 140 again to reset the associated relay 230, thus illuminating the light source 116 for another time delay period.

To set up the lighting system, the time delay for each relay 230 is preset. That is, the numerical switches 232, multiplier switches 236, and time units switch 234 should be set to the desired values. Notice that, since each switch set 142 controls a separate relay 230 (and associated light source 116), each light source 116 can have a different time delay, in general, from every other light source 116. Thus, by minimizing the illumination of light sources over file aisles 20 in which no one is working, the low voltage storage warehouse lighting system of the present invention significantly reduces the operating costs associated with lighting a storage warehouse.

While the invention has been described and illustrated with reference to specific embodiments, those skilled in the art will recognize that modification and variations may be made without departing from the principles of the invention as described hereinabove and set forth in the following claims.

We claim:

1. In a storage warehouse having a plurality of racks, said racks aligned substantially parallel to one another and spaced to form file aisles between adjacent racks, each said file aisle having a plurality of levels, each said level having an ingress and an egress, said storage warehouse having a high voltage input to a breaker panel, a storage warehouse lighting system comprising:

a plurality of switch sets, each said switch set comprising a plurality of switches, the plurality of switches within each said switch set electrically connected in serial with one another via low voltage wiring, said low voltage wiring disposed within said racks;

a plurality of light sources, at least one said light source located above each said file aisle, each said light source associated with one said switch set, each said switch set associated with one said light source; and a timer-relay station, said timer-relay station electrically connected via high voltage wiring to said breaker panel, said timer-relay station electrically connected via high voltage wiring to each said light source, said timer-relay station electrically connected via low voltage wiring to each said switch set, said timer-relay station adapted to transform said high voltage input to a low voltage, said timer-relay station adapted to illuminate a first light source of said plurality of light sources in response to electrical signals received from a first switch set, said first switch set associated with said first light source, said timer-relay station adapted to turn off said first light source after a preset time delay.

2. The storage warehouse lighting system of claim 1, wherein said timer-relay station comprises:

a plurality of transformers, each said transformer electrically connected to said breaker panel via high voltage wiring, each said transformer adapted to transform said high voltage input to said low voltage;

a plurality of relays, each said relay electrically connected to one said transformer via a low voltage power wire, each said relay connected to one said switch set via said low voltage wiring.

3. The storage warehouse lighting system of claim 1, wherein each said switch set is associated with one said file aisle, and wherein each said file aisle is associated with one said switch set, and wherein each said switch set is located proximate said associated file aisle.

4. The storage warehouse lighting system of claim 3, wherein, for each said file aisle, one switch of said associated switch set is located proximate each said ingress, and one switch of said associated switch set is located proximate each said egress.

5. The storage warehouse lighting system of claim 1, wherein each said lighting source is linear and has a length, the length of each said light source approximately equal the length of the file aisle above which each said light source is located.

6. The storage warehouse lighting system of claim 1, wherein at least one said light source comprises a fluorescent tube.

7. The storage warehouse lighting system of claim 1, further comprising:

at least one bracket, said bracket adapted to couple one said light source to two adjacent racks.

8. The storage warehouse lighting system of claim 1, wherein each said file aisle has a corresponding time delay, and wherein said timer-relay station is adapted further to turn off said light source located over each said file aisle after said corresponding time delay.

* * * * *

UNITED STATES PATENT AND TRADEMARK OFFICE

CERTIFICATE OF CORRECTION

PATENT NO. : 6,000,810
DATED : December 14, 1999
INVENTOR(S) : Nolan et al.

It is certified that error appears in the above-indentified patent and that said Letters Patent is hereby corrected as shown below:

Column 1, line 31, please delete "34" and insert therefor -- 3 - 4 --.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*